US011760541B2

(12) United States Patent
Fricano

(10) Patent No.: US 11,760,541 B2
(45) Date of Patent: Sep. 19, 2023

(54) TAMPER RESISTANT REUSABLE WINE BOTTLE STOPPER COMPATIBLE WITH CORK-SCREW-EXTRACTORS

(71) Applicant: Phillip James Fricano, Eagle, ID (US)

(72) Inventor: Phillip James Fricano, Eagle, ID (US)

( * ) Notice: Subject to any disclaimer, the term of this patent is extended or adjusted under 35 U.S.C. 154(b) by 53 days.

(21) Appl. No.: 17/300,424

(22) Filed: Jun. 25, 2021

(65) Prior Publication Data

US 2022/0411136 A1 Dec. 29, 2022

(51) Int. Cl.
*B65D 39/00* (2006.01)

(52) U.S. Cl.
CPC .... *B65D 39/0058* (2013.01); *B65D 2539/006* (2013.01)

(58) Field of Classification Search
CPC ..... B65D 39/0058; B65D 39/0052; B65D 51/1611; B65D 51/1616; B65D 51/16
USPC ..... 215/364, 355, 307; 220/804, 801, 796, 220/374, 373, 367.1
See application file for complete search history.

(56) References Cited

U.S. PATENT DOCUMENTS 580,567 A * 4/1897 Anderson ..... B65D 49/06 215/23
5,496,862 A * 3/1996 Burns ..... C08J 9/0061 428/34.4
5,904,965 A * 5/1999 Noel ..... B65D 39/0058 428/319.3
5,944,208 A * 8/1999 Gale ..... B65D 39/16 215/296
6,179,138 B1 * 1/2001 Puleston ..... B67B 7/18 81/3.15
2005/0173371 A1 8/2005 Zeni

* cited by examiner

*Primary Examiner* — Robert J Hicks

(57) ABSTRACT

A rigid stopper (10) made of bisphenol-free polycarbonate and silicone synthetic materials, particularly for a wine bottle (48), comprises a cylindrical body (12) and two opposing faces (16, 18), and at least two compressible-elastomeric "O"-rings (22, 24) seated in corresponding circumferential grooves (26, 28) on a side (14) of the body (12). The faces (16, 18) are comprised of foramen (42, 44) respectively which communicate with a volute-cavity (40) for the purpose of accepting a cork-screw-extractor. The volute-cavity (40) is comprised of a partition (46) at a central-plane (56) for the purpose of preventing wine from leaking through the volute-cavity (40). "O"-rings (22, 24) are compressively forced into a mouth (50) of a bottle (48) positioning either face (16) or face (18) flush with the mouth (50) thereby providing adequate compressive force in maintaining position of the stopper (10). Stopper (10) having longitudinal symmetry about a central plane (56), either face (16) or (18) of stopper body (12) maintains compatibility with random orientation of the stopper (10) in "corking" process of packaging.

8 Claims, 5 Drawing Sheets

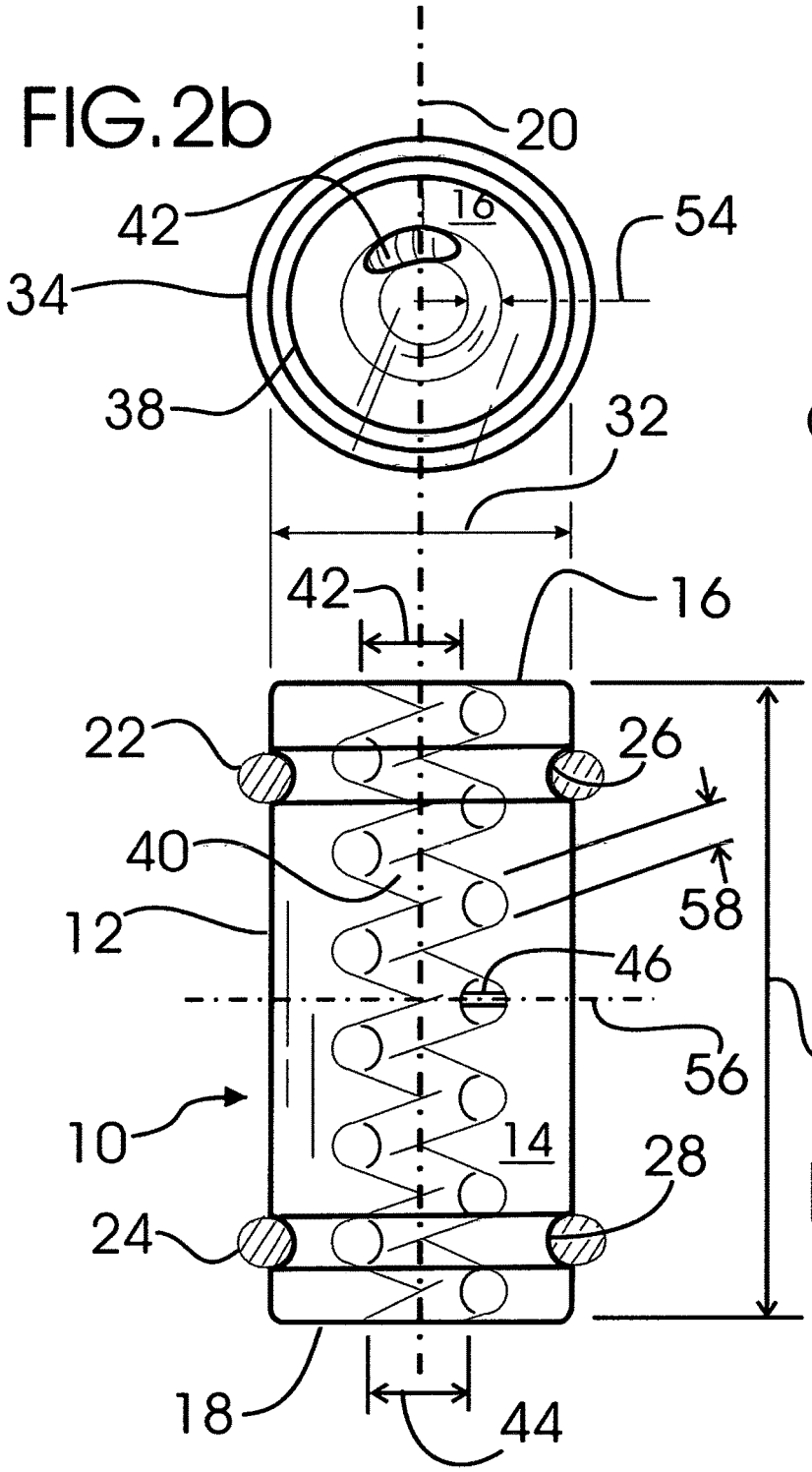
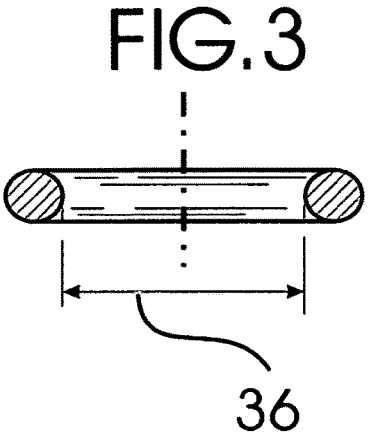
FIG.2a

TAMPER RESISTANT REUSABLE WINE BOTTLE STOPPER COMPATIBLE WITH CORK-SCREW-EXTRACTORS

CROSS-REFERENCE TO RELATED APPLICATIONS

Not applicable.

BACKGROUND FIELD OF INVENTION

The present invention relates to wine bottle closures replacing the need and implementation of cork, synthetic cork, and screw cap closures, improving the stopper insertion and extraction task yet maintaining compatibility with existing "corking machinery" and devices for stopper extraction from wine bottles.

BACKGROUND—DESCRIPTION OF PRIOR ART

Wine bottles are commonly sealed with either a cork, synthetic cork, or screw-cap closures. The cork stopper dates back some three hundred years when glass bottles were hand blown, and no two bottles were alike. Variation in bottle mouth and neck inside diameter rendered it necessary to utilize the cork stopper because of the extremely compressible and accommodating nature of cork to fit a wide range of the inside diameter of bottles. With today's high demand for cork closures, the limited supply of cork has adversely affected the availability of acceptable quality of cork, resulting in significant price increases, and the surrender of implementing screw cap closure. In keeping with the natural and synthetic cork closure for bottled wines, three percent to 10 percent of wine is wasted and discarded due to defective natural and synthetic corks. Although not harmful, cork can contain unacceptable levels of a substance known as TCA (trichloranisole) causing taint-contamination that can make wines smell and taste musty. With cork stoppers, bottled wines also age inconsistently, depending on cork quality and cork-to-bottle sealing reliability. In so far as synthetic cork stoppers utilized in lieu of cork, these stoppers tend to oxidize after approximately two years, rendering them unreliable. Furthermore, the cork closure can be difficult to extract from the wine bottle, especially by a person inexperienced in this task. In the event that cork disintegrates when attempting to extract it, fragments of the cork remain floating within the wine bottle and can pass into the serving glass or decanter when pouring, rendering the wine inappropriate to serve. Such failures in cork stoppers cause considerable waste and financial impact in the wine industry. With cost concerns, growing demand for high-quality cork, and diminishing availability of cork, the screw-cap proved least expensive and most reliable for bottled wine closures. This conversion from the cork-accepting bottle to the cap-accepting threaded bottle configuration requires expensive modification, if not replacement in the wine bottle closure machinery. Most important is the risk of producers losing marketability by offering bottled wine comprised of the undesirable "screw-cap" closure in lieu of the "cork" stopper. It is a world-wide opinion that the "screw-cap" bottled wine gives consumers the impression that the wine is of low quality, high production, and lack of mystique or romance in the art of opening a bottle of wine. Furthermore, the screw-cap can render the bottled wine easy to maliciously open.

In practice, it has been observed that well-known synthetic stoppers, despite having numerous advantages compared to cork stoppers, have a lower sealing action in the long term. Cork has the advantage that, in the presence of external moisture and a damp environment, it expands until it adheres completely to the inner wall of the bottle. Synthetic stoppers made of thermoplastic material only absorb moisture in negligible quantities and can only rely on their intrinsic resilience to adhere to the inner wall of the bottle. Gaps are therefore created between the stopper and the bottle neck glass wall allowing oxygen to filter from the surrounding atmosphere into the bottle.

In order to guarantee the sealing action, the material used for these aforementioned annular elements must therefore embrace various properties, such as high elasticity, low gas permeability, high compatibility for alimentary use and at a cost which is acceptable. It is difficult to achieve a good compromise between these properties, without affecting the sealing action of the stopper.

SUMMARY

In accordance with the present invention, a wine bottle closure comprises a rigid body with compressible elastomeric O"-rings and a volute-cavity within the body providing quick and easy extraction from the wine bottle and superior performance over synthetic cork, cork, and screw-cap closures.

Objects and Advantages

A primary object of the present invention is that of eliminating the above-mentioned drawbacks by providing a stopper comprised of:

(a) a body made of rigid plastic material; the body comprised of compressible elastomeric "O"-rings for sealing closure with a bottle and a volute-cavity for quick, effortless and accurate removal of the stopper from the wine bottle. This is accomplished simply by inserting a cork-screw-extractor into the volute-cavity of the stopper, with less effort than is experienced in the task of extracting a cork. A cork or synthetic cork require that the cork-screw-extractor be properly positioned so that the spiral-screw tip component of the extractor is relatively concentric with the exposed face of the cork. Careless positioning of the extractor, too close to the peripheral edge of the cork, or inserting the extractor's screw angular and unparallel to the vertical centerline of the bottle can result in disintegration of the cork, making the cork removal difficult or impossible to extract.

(b) A particular aspect of the present invention is that of maintaining the familiar task of extracting the stopper virtually identical to that when extracting a cork.

(c) A further aspect of the present invention is that of providing an alternative closure to a screw-cap closure.

(d) A further aspect of the present invention, pertaining to the bottle "closure" process of wine bottling is to avoid costs in having to modify or purchase machinery to provide compatibility when inserting the stopper into a wine bottle, a process referred to as "corking" in the bottled wine industry.

(e) A further aspect of the present invention directed to wine producers is that of maintaining and expanding customer base.

(f) A further aspect of the present invention is providing a stopper that exceeds the reliability of the cork over time.

(g) A further aspect of the present invention is introducing a stopper with a unique visual appeal of the volute-cavity, discovered upon extraction from the bottle, enhancing a desire of collectability of the stopper.

(h) A further aspect of the present invention is introducing a stopper with a unique visual appeal of the translucence of the stopper body, which can be clear or color, enhancing a desire of collectability.

(i) A further aspect of the present invention is to attract new consumers, and maintain brand loyalty of return consumers by providing a stopper in lieu of a screw-cap bottle closure, which connotates "cheap", "low-end" product quality.

(j) A further aspect of the present invention is to provide a stopper that eliminates product loss due to cork failure during the aging process, diminishing shelf-life.

(k) A further aspect of the present invention is to provide a stopper that will not contaminate wine flavor or smell . . . termed "cork-taint".

(l) A further aspect of the present invention is to provide a stopper that is easily reusable.

(m) A further aspect of the present invention is to provide a stopper that will not disintegrate.

(n) A further aspect of the present invention is to provide a stopper that is tamper-resistant, unlike a "screw-cap" closure that can easily and maliciously be opened.

(o) A further aspect of the present invention is to provide a stopper of consistent quality.

(p) A further aspect of the present invention is to provide a stopper that identifies "brand identity".

(q) A further aspect of the present invention is to provide a stopper that is recyclable.

(r) A further aspect of the present invention is to provide a stopper that is independently marketable, sold separately, not a component of the bottled wine. Still further objects and advantages will become apparent from a consideration of the ensuing description and accompanying drawings.

BRIEF DESCRIPTION OF THE DRAWINGS

FIG. 2*a* shows a side view of the stopper according to the invention as a whole, showing a component of the stopper in cross-section.

FIG. 2*b* shows a top view of the stopper according to the invention as a whole.

FIG. 3 shows a cross-section side view of a component of the stopper according to the invention.

Reference Numerals In Drawings

Figure 1:
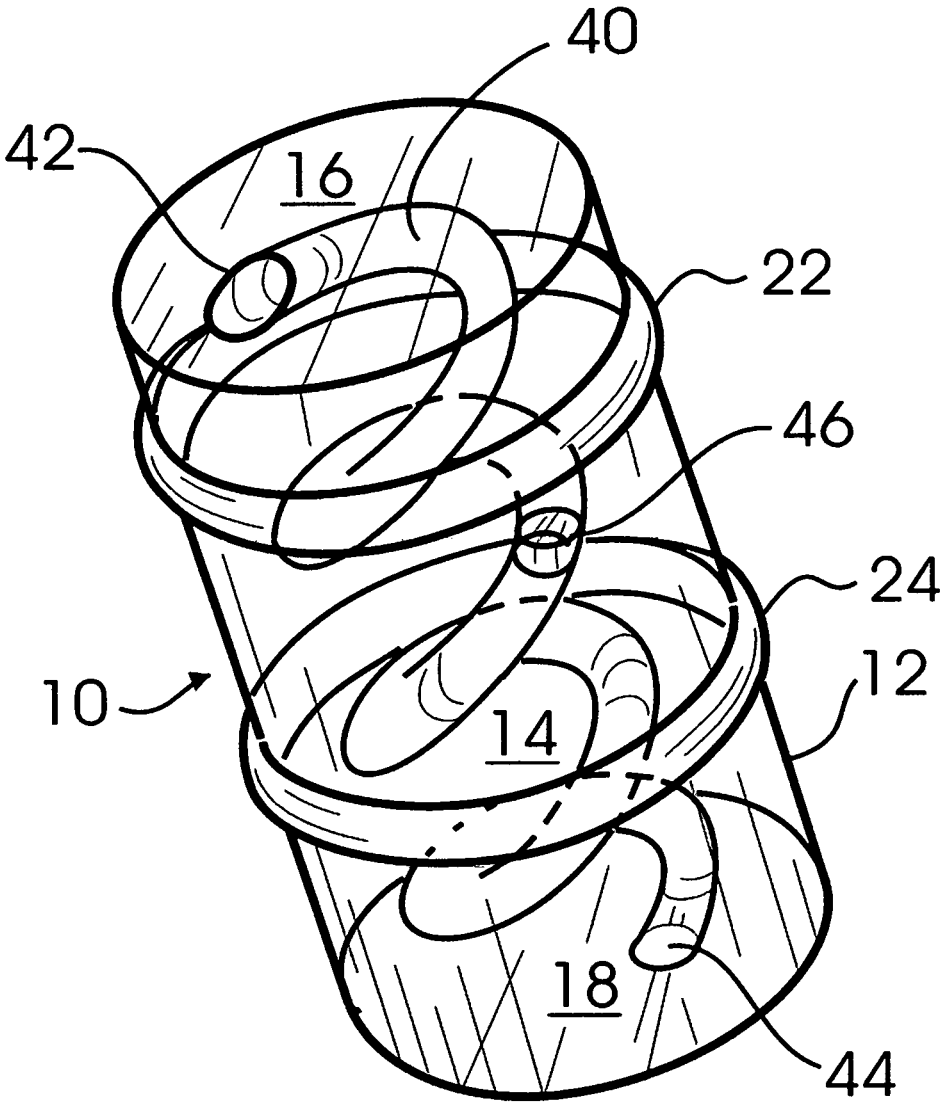
FIG. 1 shows a perspective view of the stopper according to the invention as a whole.

| | | | |
|---|---|---|---|
| 10 | stopper | 12 | body |
| 14 | side | 16 | face |
| 18 | face | 20 | axis |
| 22 | "O"-ring | 24 | "O"-ring |
| 26 | circumferential-groove | | |
| 28 | circumferential-groove | | |
| 30 | stopper-body length | 32 | stopper-body diameter |
| 34 | stopper diameter with "O"-rings | 36 | internal-diameter |
| 38 | diameter | 40 | volute-cavity |
| 42 | foramen | 44 | foramen |

-continued

Reference Numerals In Drawings

| | | | |
|---|---|---|---|
| 46 | partition | 48 | bottle |
| 50 | mouth | 52 | neck |
| 54 | interior-neck | 56 | central-plane |
| 58 | cross-section diameter | 60 | blunt-face |
| 62 | conical-face | 64 | length |
| 66 | length | | |

DETAILED DESCRIPTION OF A PREFERRED EMBODIMENT

With particular reference to the aforementioned figures, the stopper is shown according to the invention, denoted in its entirety by reference number 10 and suitable in particular for wine bottles.

FIG. 1 is a perspective view of a stopper 10 according to the invention as a whole. The stopper 10 comprises a substantially cylindrical body 12 made of transparent rigid plastic defining a longitudinal-axis 20 first shown in FIG. 2*a*. The body 12 has a side 14, with a face 16 and a face 18 which are mutually parallel to the perpendicular axis 20. The stopper 10 further comprises a compressible-elastomeric "O"-ring 22 and a compressible-elastomeric "O"-ring 24 which provide friction to maintain relative position of the stopper 10 when seated into a wine bottle 48 providing adequate closure, preventing leakage of the contents of wine between the stopper 10 and a neck 52 of the bottle 48. The task of extraction of the stopper 10 from the bottle 48 is provided by a volute-cavity 40 which provides for insertion of a cork-screw-extractor, greatly simplifying the task of extracting the stopper 10 from the wine bottle 48 shown in FIG. 4.

FIG. 2*a* is a side view of the stopper 10 according to the invention as a whole. Dimensionally, a length 30 of the stopper 10 and a diameter 32 of the stopper body 12 are of a predetermined comparability to the dimensions of a cork and synthetic cork for the purpose of maintaining compatibility with existing closure equipment in the process of "bottling". Insertion of a cork during the bottle closure process is referred to as "corking". Located on the cylindrical side 14, the compressible-elastomeric "O"-ring 22 and the compressible-elastomeric "O"-ring 24 are seated into a corresponding circumferential-groove 26, and a circumferential-groove 28 respectively. The groove 26 is positioned in a predetermined proximity to the face 16 and the groove 28 is positioned in a predetermined proximity to the face 18. Arrangement of the groove 26 and the groove 28, and subsequently the "O"-ring 22 and the "O"-ring 24 respectively, establish a longitudinal symmetry about a central-plane 56. The volute-cavity extends the length 30 of the stopper body 12, communicating at the face 16 with a foramen 42 thereto extending to the face 18 with a foramen 44, further establishing the longitudinal symmetry about the central plane 56. Mid-length of the body 12 and in alignment of the central-plane 56, the volute-cavity 40 is comprised of a partition 46, first shown in FIG. 1, which is required to prevent leakage of the wine contents through the volute-cavity 40 from within the bottle 48. Placement of the partition 46 at either the face 16, or the face 18 in lieu of placement mid-length of the volute-cavity 40 would defeat the purpose of being able to randomly orient the stopper 10 with respect to the bottle 48 during the closure process at time of production, and would be inconsistent with the intent to maintain symmetry about the central-plane 56. It is essential that the volute-cavity 40 accommodate the possible variations of cross-section diameter of cork-screw-extractors produced by various different manufacturers. A cross-section diameter 58 of the volute cavity 40 is of a predetermined greater diameter than that of a cork-screw-extractor's "screw" diameter of cork-screw-extractors diameter, therein providing tolerance for variations in the cross-section "screw" produced by various manufacturers. Furthermore, having the cross-section diameter 58 of the volute-cavity 40 a predetermined slightly greater cross-section diameter than that of a cork-screw-extractor provides for insertion of the extractor without having to exert force to overcome friction between the extractor and the volute-cavity 40.

FIG. 2*b* is a top view of the stopper 10 according to the invention as a whole, showing the foramen 42 and a diameter 38 which is technically referred to as the root diameter of both the circumferential-groove 26 and the circumferential-groove 28. The diameter 38 establishes seating and the maintaining of tension of the compressible-elastomeric "O"-ring 22 and the compressible-elastomeric "O"-ring 24 at a predetermined lesser diameter 32 of body 12.

FIG. 3 is a cross-section view of the "O"-ring 22 which is identical to the "O"-ring 24, showing a internal-diameter 36 when the "O"-ring 22 and the "O"-ring 24 are independent and at rest, from the body 12. During the assembly of the stopper 10, the "O"-ring 22 and the "O"-ring 24 are stretched and then inserted into the grooves 26 and 28 respectively, where they remain elastically under tension owning to the fact that the internal-diameter 36 of the "O"-ring 22 and the "O"-ring 24 decreases until it is the same as the diameter 38 shown in FIG. 2*b* of the grooves 26 and 28 respectively. When seated into the groove 26 and the groove 28, the "O"-ring 22 and the "O"-ring 24 respectively provide for compressively inserting the stopper 10 into a mouth 50 at a neck 52 of the bottle 48 shown in FIG. 4, irrespective of the face 16 or the face 18 being inserted into the mouth 50 at the neck 52 of the bottle 48 during the initial closure process of "bottling". The "O"-ring 22 and the "O"-ring 24 are both made of non-toxic, food-grade silicone material. The body 12 is preferably made of the thermo-plastic material bisphenol-free polycarbonate, a non-toxic category, can be injection molded in clear or a variety of transparent or non-transparent colors. The "O"-ring 22 and the "O"-ring 24 are made of food-grade material, and are available in either transparent or a variety of colors.

Figure 4:
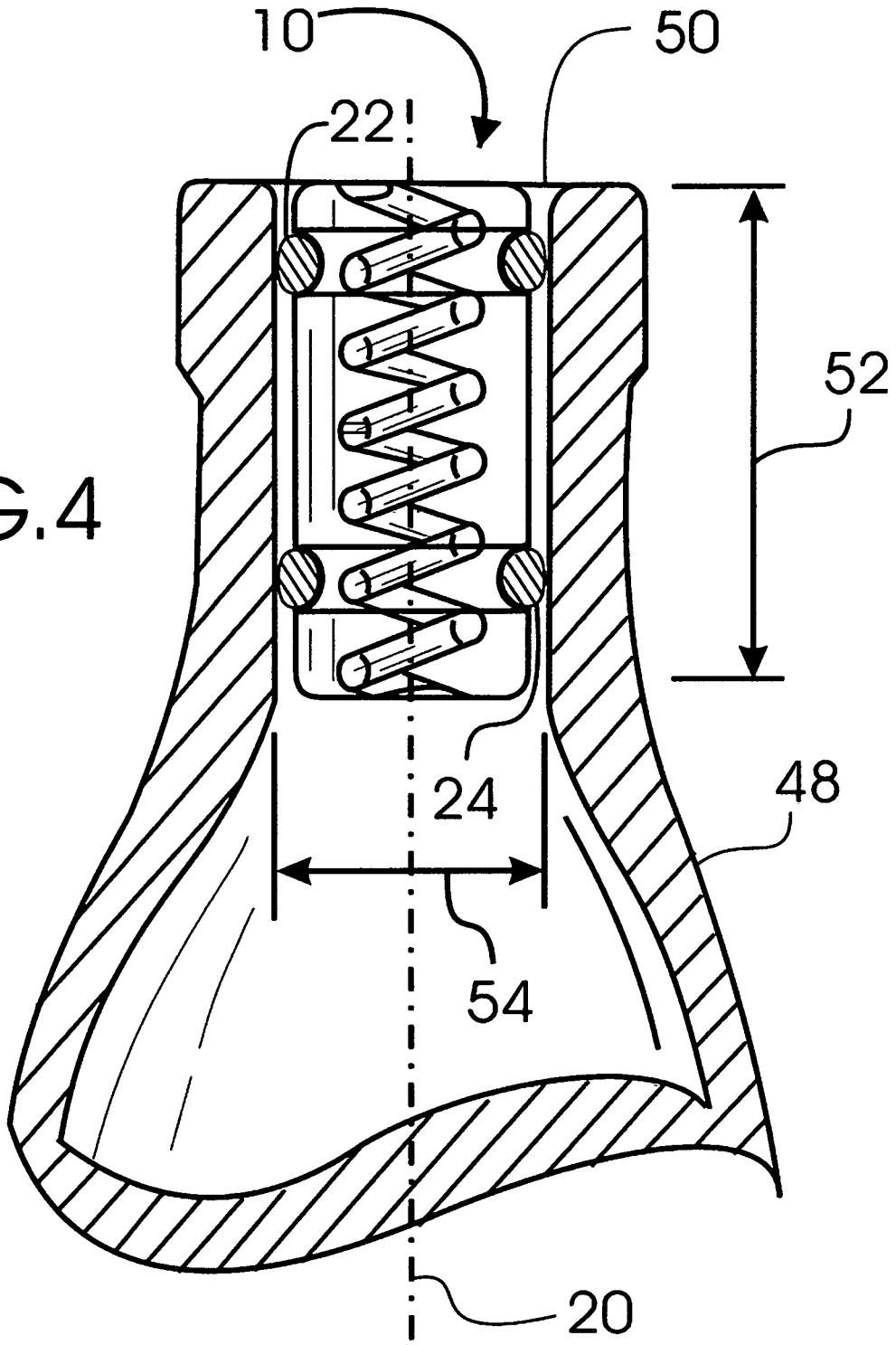
FIG. 4 shows a side cross-section view of a bottle with full-side view of the stopper inserted into the bottle with a component of the invention shown in cross-section.

FIG. 4 is a side cross-section view of the bottle 48 with full side view of the stopper 10 inserted into a interior-neck 54 of the bottle 48 showing in cross-section the "O"-ring 22 and the "O"-ring 24 elastically seated in the groove 26 and groove 28 respectively.

From the operation point of view of the production "bottling" process of inserting the stopper 10 through the mouth 50 and into the neck 52 of the bottle 48, the stopper 10 is inserted by means of a predetermined force, to the extent that either the face 16 or face 18 is flush with the mouth 50 of the bottle 48, causing both of the "0"-rings 22 and 24 to compress against the interior of the neck 52 establishing adequate friction for maintaining a seated position requiring force to extract the stopper 10 from within the bottle 48 when extraction of the stopper 10 is desired. Having defined that the "O"-rings 22 and 24 are elastically and compressively positioned, establishing a "gasket-like" seal between the stopper 10 and the interior-neck 54 of the bottle 48, it is plausible to understand that the contents of wine within the bottle 48 is adequately contained and will not leak from between the stopper 10 and the interior neck 54 of bottle 48.

The burden to the consumer having to contend with the difficult and time-consuming task of inserting the cork-screw-extractor into either the solid cork stopper or the solid synthetic cork stopper is omitted with the stopper 10 comprised of the volute-cavity 40. When the stopper 10 is desired to be extracted from the bottle 48, the cork-screw-extractor's sharp tip is targeted at whichever foramen 42 or foramen 44 is exposed at the mouth 50 of bottle 48. The extractor is then rotationally inserted clockwise into the volute-cavity 40 until the extractor tip insertion comes in contact with the partition 46.

There are major advantages of the stopper 10 over the cork stopper. Inconsistency in cork density, and flaws due to the nature of cork, diminishes the dependability on cork life and performance, resulting in having to dispose of bottled wines because of cork containing fungus, and cork having cavities causing oxygen from the environment to filter into the bottle 48, contaminating the wine contents and therefore rendering the wine unsaleable. Inconsistency in cork density can also make the task of extraction of the cork from the bottle 48 using the cork-screw-extractor difficult or impossible, whereby the cork disintegrates leaving cork particles floating within the bottle and passing these particles into a drinking glass or flask which is undesirable, creating product loss and thusly revenue. Both cork and synthetic cork can be difficult to extract using the cork-screw-extractor, even when the extraction is performed by someone experienced in the task. The extractor tip must be targeted into a position onto the exposed top of the cork, keeping the extractor clear of the cork edge against the inner edge of the bottle 48 mouth 50 which can render the extraction task difficult or impossible, having to attempt other means of the extraction task, such as removal of the cork using one's hand, or attempt re-insertion of the extractor into the cork at another position onto the exposed top of the cork. The volute-cavity 40 enables the task of extraction reliable, quick and easy. Furthermore, the body 12 made of a rigid "food-grade" plastic provides superior quality-control and uniformity in density, omitting the risk of "cork-taint" resulting in reduction of product loss. The "O"-ring 22 and the "O"-ring 24 are made of compressible elastomeric "food-grade" silicone providing for superior quality control and uniformity resulting in reduction of product loss.

Another advantage in the stopper 10 is availability in obtaining the body 12 in clear-transparent, color-transparent thermo-plastic, whereby the volute-cavity 40 visibility adds to the collectability of the stopper 10.

Another advantage in the stopper 10 is the option to "stamp" the "brand" trademark or other information onto the cylindrical side 14 of the body 12 of the stopper 10.

Yet another advantage in the stopper 10 is availability in obtaining the body 12 in non-transparent thermo-plastic.

It is intended that the stopper 10 be compatible with existing packaging equipment in the operation of initially inserting the stopper 10 into the bottle 48, a technical term in the wine-bottling industry referred to as "corking", thereby avoiding having to modify packaging machinery or the need to purchase new machinery. In the event a membrane component of the bottle 48 packaging process is installed to shield the exposed face 16 or the face 18 of the stopper 10, the mouth 50 and the neck 52 of the bottle 48, the process is the same as shielding the bottle 48 with the cork or synthetic cork closure.

Subsequent to the initial opening, stopper 10 can be reinstalled into bottle 48 by forcibly inserting stopper 10 into the mouth 50 of bottle 48 providing engagement of at least one "O-ring insertion, either the ring 22 or the ring 24, or if so desired, the stopper 10 can be completely inserted into the bottle 48 whereby the stopper 10 is flush with the top of the mouth 50 of the bottle 48. In the event that stopper 10 is desired to be kept as a novelty, the "O"-rings 22 and 24 can be clear or pigmented transparent in a variety of different colors which can provide identification to the various wine manufacturers, and wine types. Again, transparency of the stopper 10 body 12 provides for volute-cavity 40 to be aesthetically appreciated. Stopper body 12 can be engraved, etched or pigmented a variety of colors for identification for deeming stopper 10 a collectable. Furthermore, the uniqueness of stopper 10 provides the opportunity to market stopper 10 independently as an accessory, for re-closure of bottles not equipped with stopper 10.

ADDITIONAL EMBODIMENTS

There are various other possibilities with regard to the body 12 as shown in FIG. 1. In lieu of providing the partition 46 within the volute-cavity 40, allowing the cork-screw extractor to further penetrate the volute cavity 40 beyond the central plane 56, provide a pressure-sensitive transparent disk membrane (not shown) onto both the face 16 and the face 18 of the body 12 for the purpose of sealing-off the foramen 42 and the foramen 44 respectively at both the face 16 and the face 18 respectively of the body 12 preventing leakage, thusly omitting need for the partition 46 mid-way of the volute-cavity 40, thusly maintaining the symmetry of the stopper 10 in consideration for simplifying the "corking process".

Figure 5:
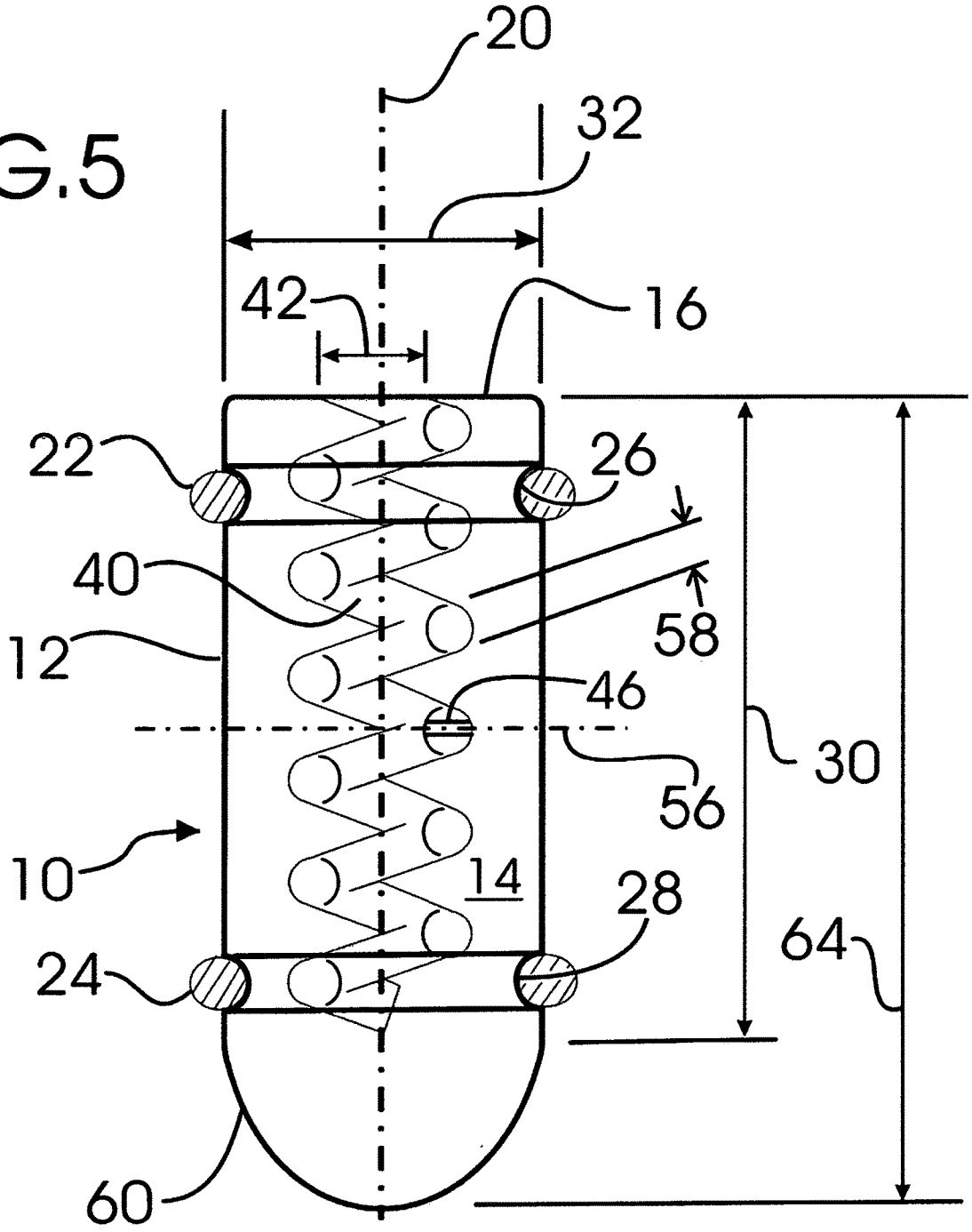
FIG. 5 shows a side view of a alternate embodiment of the stopper according to the invention as a whole showing an component of the stopper in cross-section.

FIG. 5 is a side view of a alternate embodiment of the stopper 10 according to the invention as a whole, showing a blunt-face 60. Body 12 of stopper 10 is comprised of only the foramen 42 at the face 16 communicating with the volute-cavity 40. The blunt-face 60 is opposite the exposed end face 16 of the stopper body 12 serving to "pilot" the stopper 10 into the bottle 48. The blunt-face 60 extends the length 30 of the body 12 to a extended length 64. This embodiment may however, require modification to machinery necessary to orient the stopper 10 with the mouth 50 of the bottle 48 whereby the blunt-face 60 end enters the mouth 50 of the bottle 48 first when making "closure".

Figure 6:
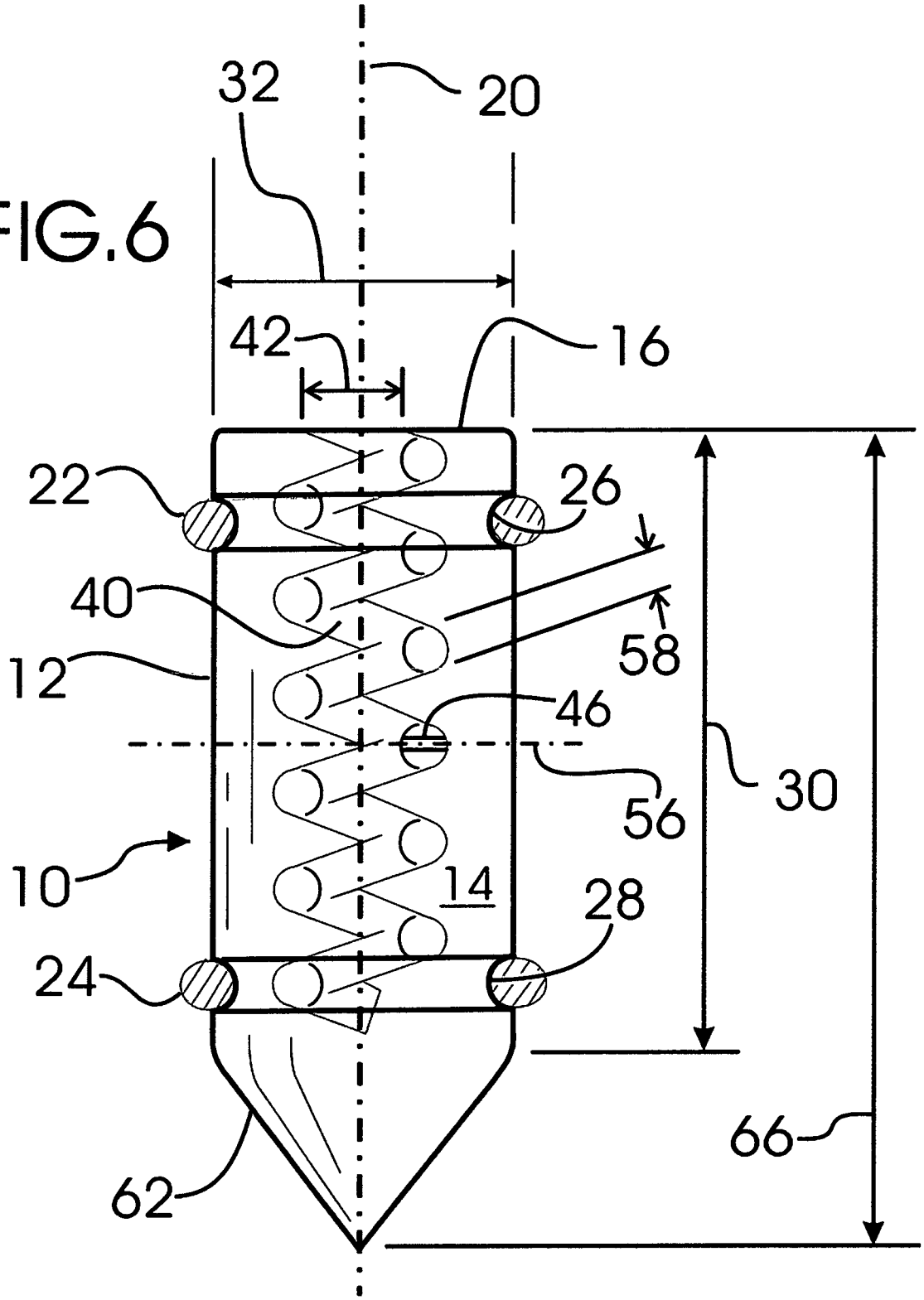
FIG. 6 shows a side view of yet another alternate embodiment of the stopper according to the invention as a whole showing a component of the stopper in cross-section.

FIG. 6 is a side view of a alternate embodiment of the stopper 10 according to the invention as a whole, showing a conical face 62. Body 12 of stopper 10 is comprised of only a foramen 42 at a face 16 communicating with the volute cavity 40 which extends to the length 30 of the cylindrical side 14 and, thereby requiring that the stopper 10 be inserted into the mouth 50 of bottle 48, having the foramen 42 exposed and aligned flush with the mouth 30 of the bottle 48, thereto providing the conical-face 62 opposite the exposed face 16 of the stopper body 12 serving to "pilot" the stopper 10 into the bottle 48.

This embodiment may, however, require modification to machinery necessary to orient the stopper 10 with the mouth 50 of the bottle 48 whereby the conical-face 62 enters the mouth 50 of the bottle 48 first when making "closure".

Thus the scope of the invention should be determined by the appended claims and their legal equivalents, rather than by the examples given.

Conclusions, Ramifications, and Scope

Accordingly, it can be seen that the wine bottle stopper of the present invention provides a quality, cost effective, readily implementable in the "corking" process, durable, reliable, reusable, simple and quick means to extract the stopper using a cork-screw-extractor. Unlike a screw-cap closure, the stopper of the present invention is tamper-resistant. Unlike a screw-cap closure which implies to the consumer a "low-quality" low-end product, the stopper of the present invention, much like the cork stopper, maintains a romantic, traditional and sense of quality in the wine it is preserving. The stopper of the present invention will not disintegrate as will cork, leaving pieces of cork floating in the wine bottle and glass into which it is being poured, rendering it undesirable. Unlike cork, the stopper of this invention eliminates the possibility of "cork taint", the musty undesirable taste and odor caused by TCA. Furthermore, the stopper of the present invention is provided with a volute-cavity for effortless and accurate insertion of a cork-screw-extractor into the stopper and dependable extraction by eliminating risk of failure in extraction that could occur when extracting cork or synthetic cork. The stopper of this invention eliminates waste of product lost due to natural or synthetic cork failure. Although the description above contains many specificities, these should not be construed as limiting the scope of the invention but as merely providing illustrations of some of the presently preferred embodiments of this invention. Various other embodiments and ramifications are possible within its scope.

The invention claimed is:

1. Stopper made of synthetic materials, comprising:

a substantially cylindrical body comprised of two faces perpendicular to a longitudinal axis whereby either said face of said cylindrical body positioned to rest flush with a mouth of a bottle for the purpose of maintaining compatibility with existing closure equipment in the process of bottling;

said body made of thermoplastic;

said body comprised of a volute-cavity traversing concentrically along said longitudinal-axis;

said faces comprised of a foramen communicating with said volute-cavity;

said volute-cavity comprised of a partition positioned mid-length of said cylindrical body establishing symmetry about a central plane;

said partition preventing leakage of contents of a bottle from leaking through said volute-cavity;

said volute-cavity for the purpose of inserting a cork-screw-extractor for removal of said stopper from said bottle.

2. Stopper according to claim 1, characterized in that the material of said cylindrical body is non-toxic food-grade.

3. Stopper according to claim 1, characterized in that said cylindrical body is bisphenol-free polycarbonate, a non-toxic category material having a formulation able to ensure complete compatibility for alimentary use and a high resistance to aging.

4. Stopper made of synthetic materials, comprising, a substantially cylindrical body comprised of one blunt-face and one face configured to rest flush with a mouth of a bottle for the purpose of maintaining compatibility with existing closure equipment in the process of bottling;

said faces perpendicular to a longitudinal-axis;

said body made of thermoplastic;

said body comprised of a volute-cavity commencing at a foramen located at said face of said cylindrical side configured to rest flush with said mouth of said bottle;

said volute-cavity extending a predetermined distance towards said blunt-face;

said volute-cavity for the purpose of inserting a cork-screw-extractor for removal of said stopper from said bottle.

5. Stopper according to claim 4, characterized in that the material of said cylindrical body with said blunt-face is non-toxic category food grade.

6. Stopper according to claim 4, characterized in that said body is bisphenol-free polycarbonate, a non-toxic category material having a formulation able to ensure complete compatibility for alimentary use and a high resistance to aging.

7. Stopper made of synthetic materials, comprising:

a substantially cylindrical body comprised of one conical-face and one face configured to rest flush with a mouth of a bottle for the purpose of maintaining compatibility with existing closure equipment in the process of bottling;

said faces perpendicular to a longitudinal-axis;

said body made of thermoplastic;

said body comprised of a volute-cavity commencing at a foramen located at said face of said cylindrical side configured to rest flush with said mouth of said bottle;

said volute-cavity extending a predetermined distance towards said conical-face;

said volute-cavity for the purpose of inserting a cork-screw-extractor for removal of said stopper from said bottle.

8. Stopper according to claim 7, characterized in that the material of said cylindrical body with conical-face is bisphenol-free polycarbonate, a non-toxic food-grade category material having a formulation able to ensure complete compatibility for alimentary use and a high resistance to aging.

* * * * *